United States Patent [19]

Smith

[11] 3,930,607

[45] Jan. 6, 1976

[54] CONTAINER AND BLANKS THEREFOR

[75] Inventor: Ernest L. Smith, Kansas City, Mo.

[73] Assignee: Phillips Petroleum Company, Bartlesville, Okla.

[22] Filed: Jan. 20, 1975

[21] Appl. No.: 542,287

[52] U.S. Cl. ..... 229/5.5; 229/23 R; 229/21

[51] Int. Cl.[2] ..... B65D 5/12; B65D 13/04

[58] Field of Search ..... 229/5.5, 5.7, 21, 23, 25, 229/26, 43

[56] References Cited

UNITED STATES PATENTS

| | | | |
|---|---|---|---|
| 827,984 | 8/1906 | Maxwell et al. | 229/5.5 |
| 1,504,491 | 8/1924 | Nicholson | 229/5.5 |
| 2,163,703 | 6/1939 | Ringler | 229/5.5 |
| 2,726,803 | 12/1955 | Ketler | 229/5.5 |
| 3,006,522 | 10/1961 | Armeson | 229/5.5 |
| 3,157,340 | 11/1964 | Gay, Jr. et al. | 229/5.7 |
| 3,327,893 | 6/1967 | Graves | 229/5.5 X |
| 3,451,610 | 6/1969 | Beicher et al. | 229/23 R |
| 3,465,944 | 9/1969 | Robinson | 229/5.5 |

*Primary Examiner*—Davis T. Moorhead

[57] ABSTRACT

A tubular fiberboard container is formed from a tubular body having, at at least one end thereof, a flat, disk-shaped end closure supported by closure supporting panels formed from the same piece of blank material as the tubular body, or supported in part by such panels and in part by a metal band or clamp.

34 Claims, 10 Drawing Figures

CONTAINER AND BLANKS THEREFOR

This invention relates to a container and a closure therefor. In another aspect it relates to supporting means for maintaining a closure affixed to a container. In yet another aspect it relates to a container having closure supporting means which are formed from a part of a container body. In yet another aspect the invention relates to a blank from which a container body having closure supporting means of the invention can be constructed.

In the manufacture and use of fiberboard or paperboard containers, it is a common practice, dictated by economic considerations, to manufacture blanks from which the various portions of the container can be constructed at some central location, to ship the blanks to a point at or near which the containers will be used, and to assemble the containers from the blanks at or near the location where they will be used, often as a part of the container filling operation. In addition to insuring that the container, when fabricated, will be of sufficient strength to perform its job properly, it is desirable to simplify the final assembly procedure as much as possible, to utilized the most inexpensive materials available, consistent with maintaining the quality of the container, and to keep the number of different parts which must be shipped and assembled at a minimum.

Accordingly, it is an object of this invention to provide an improved container and closure therefor. Another object of the invention is to provide an improved container closure supporting system for use in paperboard containers. Yet another object of the invention is to provide a container and closure therefor which permit simplified closure design and final assembly of the carton and closure with a minimum of equipment. Still another object of the invention is to provide improved blanks from which closure-supporting containers can be constructed.

According to the invention a fiberboard container having a tubular body can be constructed for use with a flat, disk-shaped container closure. Apparatus to support the closure and maintain it in engagement with the container is formed from a part of the container body. Three preferred embodiments are disclosed, one utilizing a folded metal band as a part of the closure supporting mechanism and two employing no material other than the container body and the closures.

The preferred embodiment utilizing a folded metal band as part of the closure supporting mechanism is intended primarily for use in those applications where machinery for applying the metal band to the edge of a container or to clamp a closure to a container has been previously installed, or in those situations where a container having a metal edge at the top or bottom thereof is desired to withstand the rigors of a particular application such as, for example, contact of the edge of a container with an abrasive surface during some phase of the filling, storing, shipping, or merchandising of the container and its contents. The preferred embodiments using no material other than fiberboard and no parts other than the container body and closure members are generally suited for use in applications where circumstances dictate a minimum amount of equipment necessary for assembly of the container. The containers of this embodiment also provide a rigid container product without utilizing the relatively expensive folded metal band or other similar strengthening materials commonly used to impart rigidity to a container.

Additional objects and advantages of the invention will be apparent from the description of the drawing in which FIG. 1 is a pictorial view of a container embodying the invention;

Figure 1:
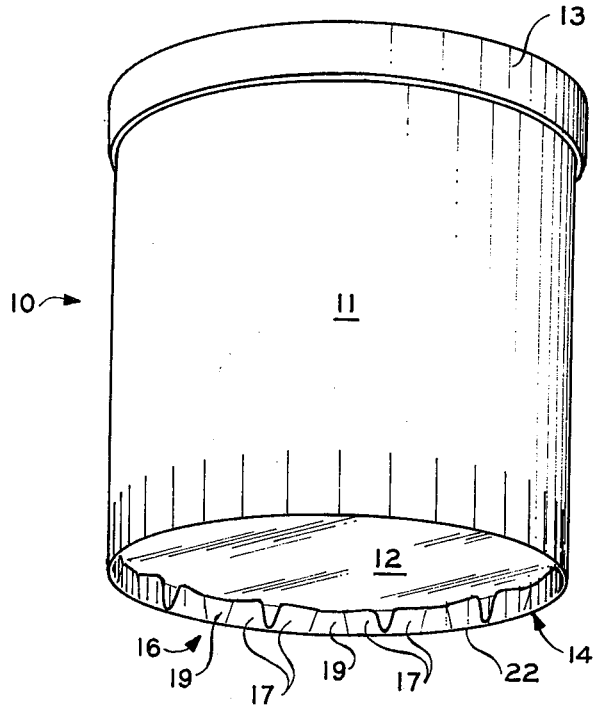

Referring now to the drawing, FIG. 1 illustrates, in a pictorial view, a container 10 having a tubular body 11, a bottom closure 12, and a closure engaging mechanism 14 constructed in accordance with the invention. The cover 13 of the container 10 can be any conventional cover or closure known in the art. The closure 12 is a flat member of relatively heavy material, preferably heavy fiberboard or corrugated fiberboard, having sufficient strength to support the intended contents of the container and having a shape consistent with the desired cross-sectional shape of the assembled container. In most applications, the closure 12 would be circular or disk-shaped, but the use of elliptical and other noncircular shapes is within the scope of the invention.

Figure 8:
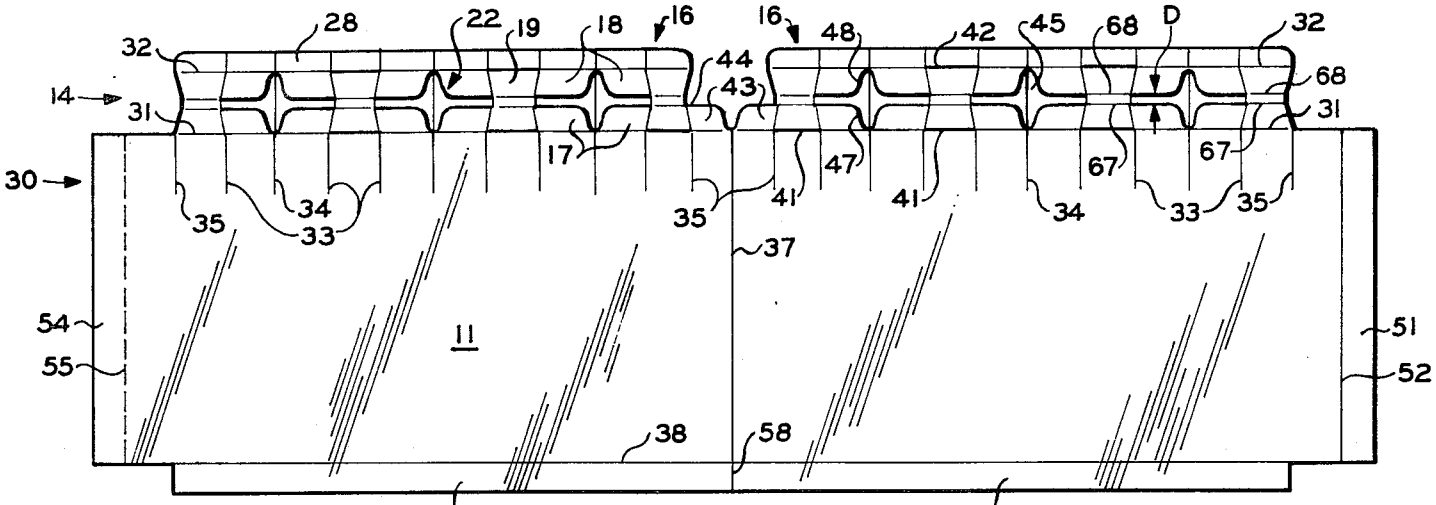
FIG. 8 is a plan view of a blank from which a preferred embodiment of the container can be constructed.
Figure 9:
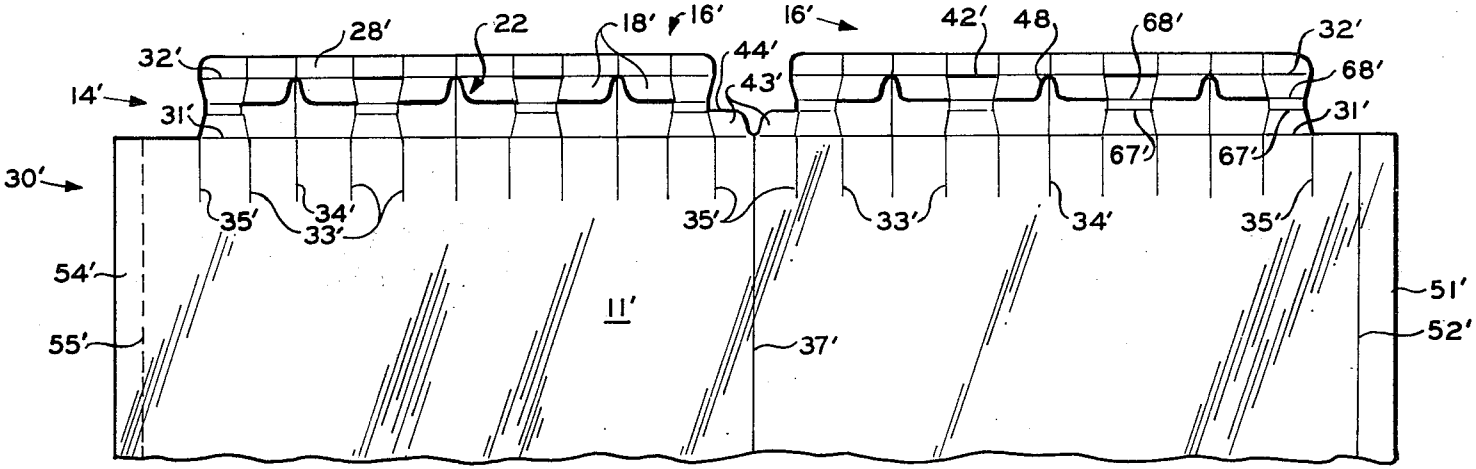
FIG. 9 is a plan view of a blank from which a preferred embodiment of the invention can be constructed.
Figure 10:
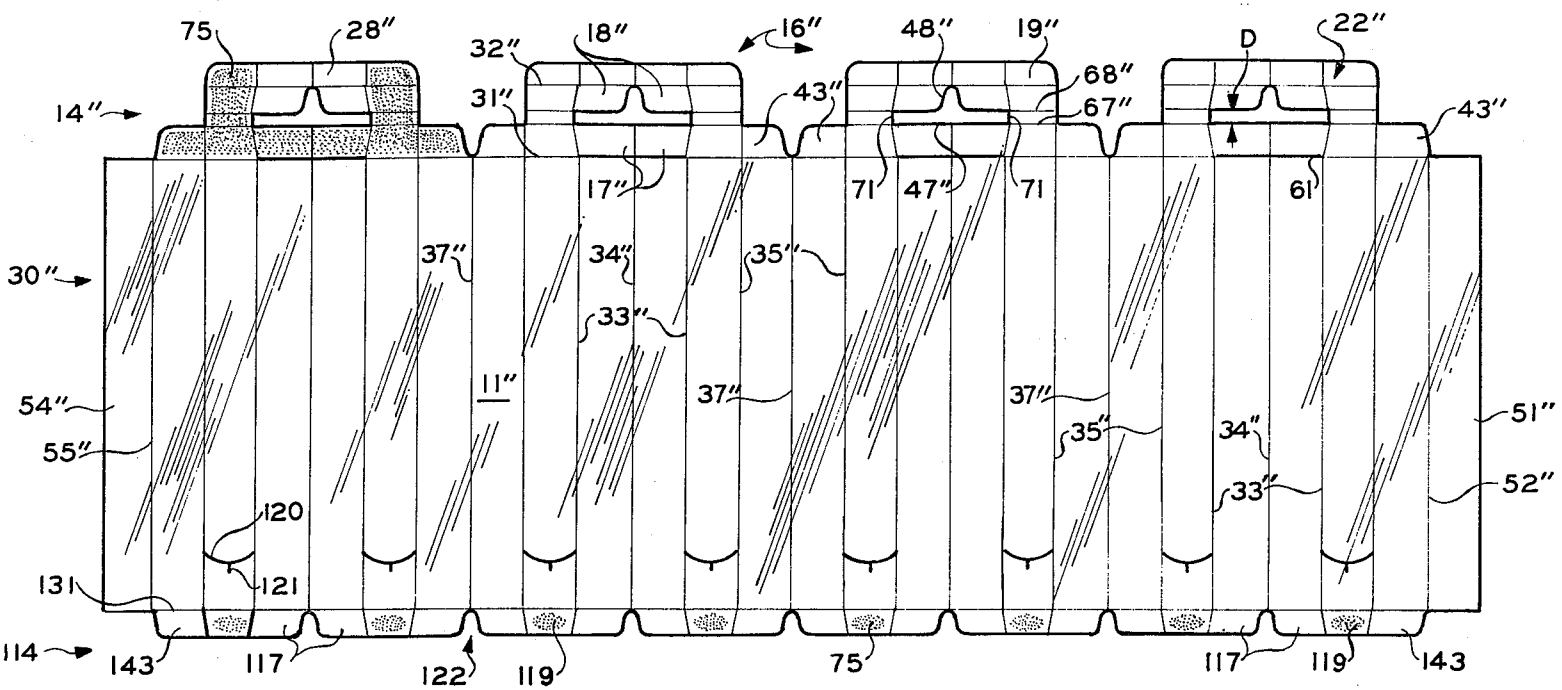
FIG. 10 is a plan view of a blank from which a preferred embodiment of the invention can be constructed.

The closure engaging means 14 can be a single closure engaging panel extending entirely or substantially around the circumference of container body 11. The closure engaging means 14 is preferably made up of two or more closure engaging panels 16 as shown in FIGS. 8–10. Each closure engaging panel has associated with it a plurality of outer supporting panels 17, a plurality of inner supporting panels 18 (FIG. 2), and a plurality of spacing panels 19. Each set of two outer supporting panels 17 and inner supporting panels 18 between consecutive spacing panels 19 comprise a closure supporting panel group 22.

Figure 2:
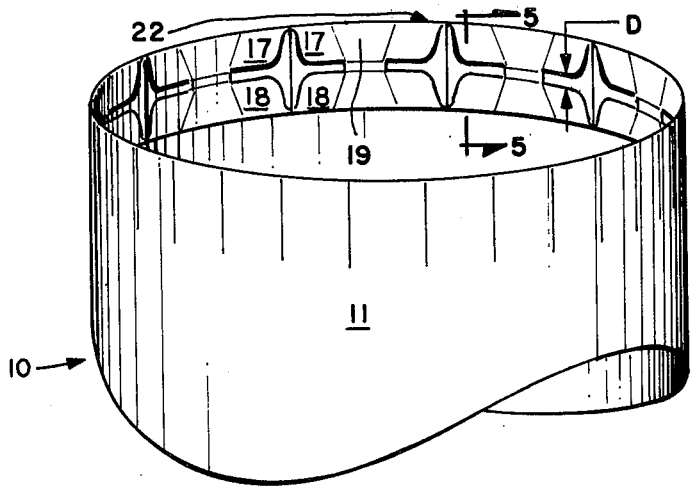
FIG. 2 is a partial pictorial view of a preferred embodiment of the invention.

FIG. 2 shows a partial pictorial view of the container of FIG. 1. The view of FIG. 2 is shown with the container of FIG. 1 in an inverted position and with the closure 12 removed. This view clearly illustrates the formation of closure supporting panel groups 22 by inner supporting panels 18 and outer supporting panels 17 as well as the location of spacing panels 19 between closure supporting panel groups 22. The distance D between inner panels 18 and outer panels 17 of each closure supporting panel group 22 is selected to be the same or slightly, but not substantially, larger than the thickness of the closure 12 to be used. The preferred embodiment of the invention illustrated by FIG. 2 can be used at either the top or the bottom of the container, or both. When the closure 12 is in place, the inner supporting panels 18 prevent its displacement toward the center of the container, and the outer supporting panels 17 impede its removal from the container. A closure 12 can be applied to the end of a container having the illustrated embodiment by inserting it into the end of the container so that it fills the cross section of the container, then forcing the closure 12 past the outer supporting panels 17. When the closure 12 has passed the outer supporting panel 17 and come to rest against the edge of the inner supporting panels 18, the outer supporting panels 17, due to their construction, the angle of the score lines separating them from spacing panels 19, and the curvature of the container, displace themselves to overlap the edge of the closure 12 and maintain it in place.

Figure 3:
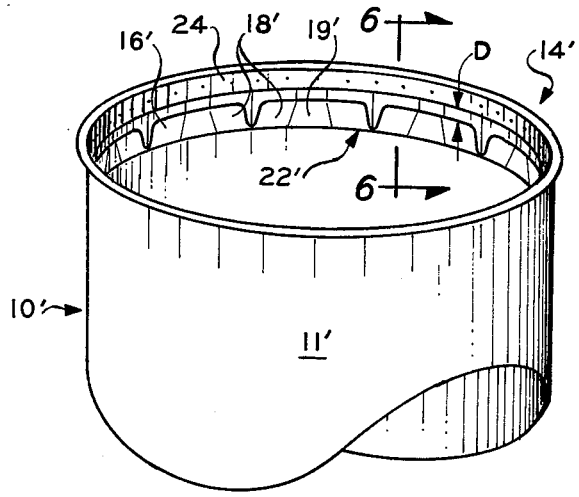
FIG. 3 is a partial pictorial view of a preferred embodiment of the invention.

FIG. 3 is a partial pictorial view showing a portion of a tubular container body 11' of a container 10' illustrating another preferred embodiment of the invention. The supporting means associated with container body 11' is illustrated with the closure 12 removed to more clearly show those portions of the closure engaging means 14' located inside the container from the normal position of the closure 12. A crimped folded metal band 24 has been applied to the edge of container body 11' along the fold line between the closure engaging panels 16' and container body 11'. In this embodiment, the closure supporting panel group 22' has only two inner supporting panels 18', and spacing panels 19' separate adjacent closure supporting panel groups 22'. In the embodiment of FIG. 3, the inner supporting panels 18' prevent the closure 12 from being moved further toward the inside of the container, and the closure is kept within the container 11' by the thickness of the metal band 24. The metal band 24, in addition to being sized to provide the desired strength or rigidity of the container, can also be varied in thickness to provide either a tight friction fit with the container closure 12 or an effective seal to prevent removal of the cover. If the ring is sized to give a tight friction fit, the container enclosure configuration is useful as the top of a container where occasional removal and replacement of the cover is desired. Increasing the thickness of the metal band to provide an effective impediment to the removal of the cover 12 is useful in an application where the closure and closure engaging means combination illustrated in FIG. 3 is to be used as the bottom of a container and it is desirable to prevent removal of the closure. If the metal ring 24 and closure 12 are sized to give a tight friction fit, the container can be fabricated, including the application of metal band 24, prior to being filled, and the closure 12 can be forced past metal band 24 into place atop the inner supporting panels 18 after the container is filled. When the metal band 24 is used to seal the closure 12 into place, the closure 12 must be put in place in contact with inner supporting panels 18' prior to application of the metal band 24.

Figure 4:
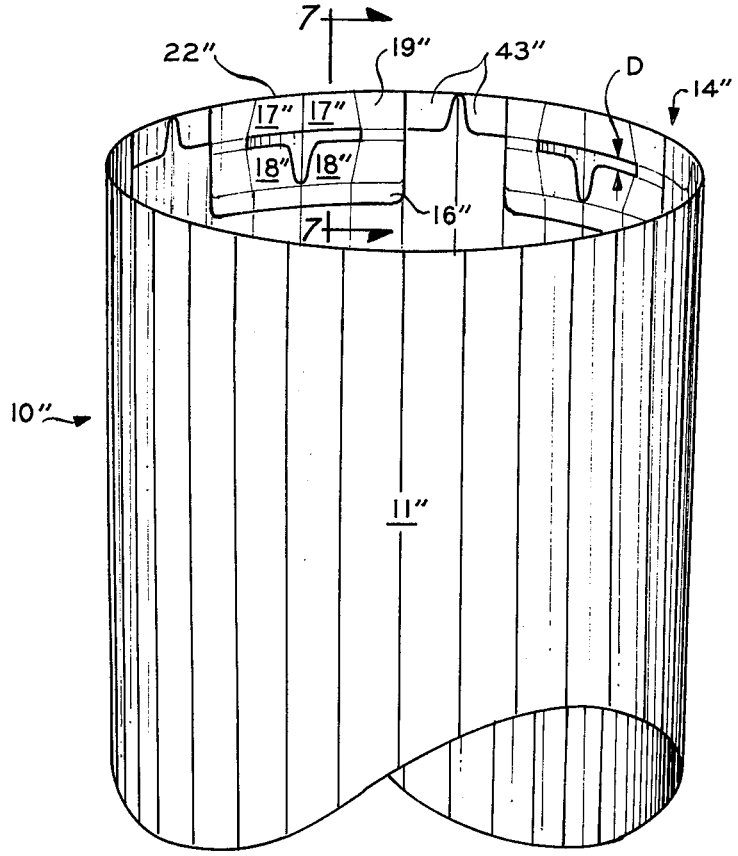
FIG. 4 is a partial pictorial view of a preferred embodiment of the invention.

FIG. 4 is a partial pictorial view showing a portion of a tubular container body 11' of a container 10'' illustrating another preferred embodiment of the invention. The supporting means associated with the container body 11'' is illustrated with the closure 12 removed to more clearly show those portions of the closure engaging means 14'' located inside the container from the normal position of the closure 12. Each closure engaging panel 16'' of this embodiment contains only one supporting panel group 22'' comprising a pair of inner supporting panels 18'' and a pair of outer supporting panels 17''. A spacing panel 19'' is located on either side of each closure supporting panel group 22''. Additional outer supporting panels 43'' can be located between adjacent closure engaging panels 16''. The material between adjacent inner supporting panels 18'' and outer supporting panels 17'' is preferably removed from the closure engaging panel 16''. The distance D between the inner panels 18'' and the outer panels 17'' is preferably the same or slightly larger than the thickness of the closure 12 to be used. The preferred embodiment illustrated by FIG. 4 is preferably used as the top of a container which will not be subject to substantial forces tending to accomplish removal of the closure 12 or in situations where easy insertion and removal of the closure 12 is desired. When the closure 12 is in place, the inner supporting panels 18'' prevent its displacement toward the center of the container, and the outer supporting panels 17'' impede its removal from the container. Since the adjacent outer supporting panels 17'' of each supporting panel group 22'' are connected along a common score line, the outer supporting panels 17'' do not pose as much resistance to closure removal as do, for example, the outer supporting panels 17 of FIG. 2. The illustrated embodiment is therefore particularly adaptable to such applications as a carry-out container for prepared food such as fried chicken or other similar applications where the packaged product is not subject to extensive shipping and handling and where easy removal of the closure 12 is desirable.

Figure 5:
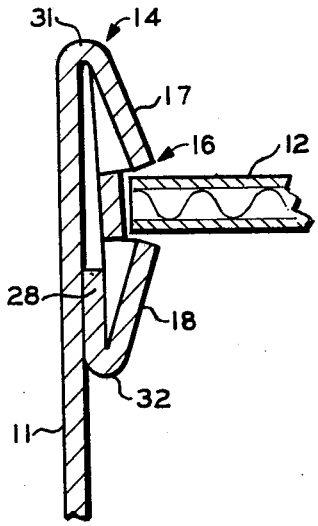
FIG. 5 is a partial cross section view along line 5—5 of FIG. 2.

FIG. 5 is a partial cross section of the embodiment of the invention illustrated by FIG. 2 with the closure 12 in place, viewed along line 5—5 of FIG. 2. In this embodiment, the closure 12 is held in place by the inner supporting panels 18 and outer supporting panels 17. The closure engaging panel 16, of which the outer supporting panel 17 and inner supporting panels 18 are a part, is folded inwardly from the container wall 11 along a hinged line of attachment 31. A bonding strip 28 is folded beneath the closure engaging panel 16 along a hinged line of attachment 32 and is attached to the inside of the body member 11 by means of an adhesive or other similar means known in the art. The presence of the bonding strip 28, in addition to enabling the closure engaging panels 16 to be secured to the inside of container body 11 helps to apply leverage to the inner supporting panels 18' along the folded line of attachment 32 between the inner supporting panels 18 and the bonding strip 28, thereby assisting in maintaining the inner supporting panels 18 in the proper position to engage the closure 12. The bending of the fiberboard material along the folded line of attachment 31 assists in maintaining the outer support panels 17 in the position required for proper interaction with the closure 12 to maintain the closure 12 in the proper position. To relieve tension along the hinged lines of attachment 31 and 32 the fiberboard material can be severed adjacent the spacing panels 19 along the hinged lines of attachment. This permits use of the hinged line to help exert a desirable opening force on the outer supporting panels 17 and inner supporting panels 18 without tending to exert a similar force on the spacing panels 19.

Figure 6:
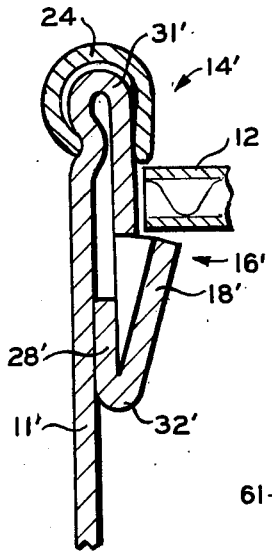
FIG. 6 is a partial cross section view along line 6—6 of FIG. 3.

FIG. 6 is a partial cross-sectional view of the container of FIG. 3, with the closure 12 in place, viewed along a line corresponding to section line 6—6 of FIG. 3. This cross-sectional view clearly illustrates the manner in which the closure engaging means 14' comprising a folded metal band 24 and inner supporting panels 18' maintains the closure 12 in place. The closure engaging panels 16' are folded inwardly from container body 11' along a hinged line of attachment 31', and a metal band 24 is crimped into place covering the hinged line of attachment 31'. On the side of the closure engaging panels 16' opposite the hinged line of attachment 31' and adjacent the inner supporting panels 18', a bonding strip 28' is folded beneath the closure engaging panels 16' and is bonded, using a suitable adhesive or other similar means known in the art, to the inside of the container body 11'. The bonding strip 28' is attached to the closure engaging panels 16' in the same manner that the bonding strip 28 is attached to closure engaging panel 16 in the embodiment of FIG. 5, and the respective bonding strips 28' and 28 perform the same function in both embodiments. To relieve tension along the hinged line of attachment 32' the container material can be severed adjacent the spacing panels 19' along the hinged line of attachment 32'. This permits use of the hinged line to help exert a desirable opening force on the inner supporting panels 18 without tending to exert a similar force on the spacing panels 19'.

Figure 7:
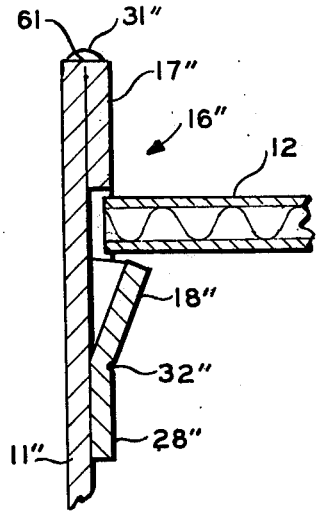
FIG. 7 is a partial cross section view along line 7—7 of FIG. 4.

FIG. 7 is a partial cross section of the embodiment of the invention illustrated by FIG. 4 with the closure 12 in place, viewed along line 7—7 of FIG. 4. In this embodiment, the closure 12 is held in place by the inner supporting panels 18'' and, to a lesser extent, by the outer supporting panels 17''. The closure engaging panels 16'', of which the outer supporting panel 17'' and inner supporting panels 18'' are a part, are folded inwardly from the container wall 11'' along a hinged line of attachment 31''. In this embodiment the outer supporting panels 17'' are preferably adhered to the inside of the container wall 11''. In order to permit the outer supporting panels 17'' to be closely adhered to the container body 11'' a cut 61 can be made along the hinged line of attachment 31'' adjacent the outer supporting panels 17''. In this embodiment the bonding strip 28'' is adhered to the inside of the container wall 11'' without being folded under the remainder of the closure engaging panel 16''. The hinged line of attachment 32'' permits the inner supporting panels 18'' to hinge slightly away from the inside of the container body 11'' in order to support the closure 12. Removal of the material between adjacent outer supporting panels 17'' and inner supporting panels 18'' in conjunction with sizing of the container body 11'' and closure 12 to provide a relatively tight fit between the closure 12 and the outer supporting panel 17'' as the closure is inserted into its position above the inner supporting panels 18'' permits the container body 11'' and closure engaging panel 16'' to relax somewhat once the closure 12 is in place, thereby permitting a small but effective overlapping of the closure edge by the outer supporting panels 17'' to effectively engage the closure 12 while still permitting its ready removal. The force necessary to provide the displacement of the inner supporting panels 18'' necessary for their effective engagement of the closure 12 is exerted by the curvature of the container body 11'', particularly along the score lines running the entire length of the container body.

FIG. 8 illustrates, in plan view, a blank from which a container incorporating the embodiment of the invention illustrated in FIGS. 1, 2, and 5 can be constructed. The blank 30 has a generally rectangular portion 11 from which the tubular body of the container is formed. A closure engaging means 14 comprising two closure engaging panels 16 is formed as a part of the blank 30 along one side of the body portion 11 thereof with the closure engaging panels 16 and the body 11 joined along a hinged line of attachment 31. The hinged line of attachment 31 is preferably a score line of sufficient size to permit ready folding of the blank along the line during assembly of the container. On the opposite side of each closure engaging panel from the hinged line of attachment to the body 11 is a bonding strip 28. Each bonding strip 28 is foldably associated with the remainder of its respective closure engaging panel 16 along a hinged line of attachment 32. The hinged line of attachment 32 is preferably a score line of sufficient size to facilitate accurate folding of the bonding strip 28 inwardly from the remainder of the closure engaging panel 16 during assembly of closure engaging means 14.

The portion of each closure engaging panel intermediate of the foldable line of attachment 31 and the foldable line of attachment 32 is made up of alternate spacing panels 19 and closure supporting panel groups 22. Each closure supporting panel group 22 comprises two outer supporting panels 17 and two inner supporting panels 18. Each closure supporting panel group 22 is delineated from the adjacent spacing panels 19 by score lines 33 extending from the edge of the bonding strip 28 opposite the hinged line of attachment 32, across the hinged line of attachment 32, across the remainder of the closure engaging panel 16, across the hinged line of attachment 31, and across a portion of the edge of body 11 adjacent the hinged line of attachment 31. Each score line 33 is bowed along its length between the hinged line of attachment 32 and the hinged line of attachment 31 so that each closure supporting panel group 22 is widest at a point approximately midway between the foldable line of attachment 31 and the foldable line of attachment 32 with the width diminishing from this widest point to narrowed points adjacent the foldable line of attachment 31 and the foldable line of attachment 32. This shaping of the closure supporting panel groups 22 gives an intermediately narrowed "hour glass" shape to the adjacent spacing panels 19. The angle between the portion of each score line 33 adjacent each inner supporting panel 18 and the portion of the hinged line of attachment 31 adjacent the inner supporting panel 18 is preferably within the range of from about 90° to about 120°. The angle between the portions of the hinged line of attachment 32 and the score line 33 adjacent each outer supporting panel 17 is preferably within the range of from about 90° to about 120°. The portions of each score line 33 located upon the body 11 and the bonding strip 28 are substantially perpendicular to the foldable line of attachment 31 and the foldable line of attachment 33, respectively.

Each spacing panel 19 which is not at the end of a closure engaging panel 16 has a cut 41 along the hinged line of attachment 31 and a cut 42 along the hinged line of attachment 32 with cuts 41 and 42 running substantially the entire width of the spacing panel 19. Cuts 41 and 42, extending the full width of a spacing panel 19, effectively disconnect the spacing panel from the body member 11 and the bonding panel 28 along the hinged lines of attachment 31 and 32, respectively.

Within each closure supporting panel group 22 the outer supporting panels 17 and inner supporting panels 18 are defined by cuts 47 and 48 which are generally parallel to each other and separated by distance D adjacent the score line 33 at each side of closure supporting panel group 22. Cuts 47 and 48 then diverge from each other in a substantially symmetrical fashion intermediate of score lines 33 defining the opposite sides of the closure supporting panel group. Cut 47 therefore extends from a score line 33 at one side of a closure supporting panel group 22 in a direction substantially parallel to the hinged line of attachment 31 for a distance of from approximately one-third to about three-eighths of the width of the closure supporting panel group 22, then curves toward the hinged line of attachment 31 and is tangent to the hinged line of attachment 31 at a point approximately midway between the intersections of the hinged line of attachment 31 with the score lines 33 defining the closure supporting panel group 22. From this midpoint, the cut 47 curves away from the hinged line of attachment 31 and returns to its original path parallel to hinged line of attachment 31 across the remaining three-eighths to one-third of the width of the closure supporting panel group 22. In a similar manner, cut 48 begins at a score line 33 in a direction parallel to cut 47 and separated from cut 47 by a distance D, curves to meet the hinged line of attachment 32 at the approximate center of the edge of closure supporting panel group 22 bounded by hinged line of attachment 32, and then returns to its original path parallel to cut 47. A score line 34 extends in a straight line from the edge of the bonding strip 28 opposite the hinged line of attachment 32 across the bonding strip 28, across the hinged line of attachment 32 at its point of tangency with cut 48, across the closure engaging panel 16, across the hinged line of attachment 31 at its point of tangency with cut 47, and onto the body 11. Score line 34 is substantially perpendicular to both the hinged line of attachment 31 and the hinged line of attachment 32 and substantially bisects the closure supporting panel group 22.

Each outer supporting panel 17 is defined by a portion of a score line 33, a portion of the hinged line of attachment 31, and the portion of cut 47 extending from intersection of the cut with the score line 33 to the point of tangency between the cut and hinged line of attachment 31. Each inner supporting panel 18 is defined in a similar manner by a portion of a score line 33, a portion of the hinged line of attachment 32, and that portion of cut 48 from the intersection of cut 48 with the score line 33 to the point of tangency of cut 48 with hinged line of attachment 32. Advantageous orientation of the outer supporting panels 17 and inner supporting panels 18 of each supporting panel group 22 in the assembled container 11 is enhanced by the length across the supporting panel group 22 from the intersections of cuts 47 and 48 with the spacing panels on either side of the supporting panel group being greater than the distance across the supporting panel group along line 31 or 32. In a preferred embodiment the configuration of each closure supporting panel group 22 is symmetrical about both the score line 34 associated with that group and with an imaginary line between, and equidistant from, cuts 47 and 48.

The portion of closure supporting panel group 22 outside the area covered by outer supporting panels 17 and inner supporting panels 18 forms a medium panel 45. Medium panel 45 is bounded by cut 47, cut 48, and two short segments of the score lines 33 defining its respective closure supporting panel group. In the preferred embodiment illustrated, medium panel 45 is bisected by the score line 34.

Each closure supporting panel group 22 has a spacing panel on either side thereof so that each closure engaging panel 16 is bounded on each end by a spacing panel 19. A score line 35 extends from the intersection of the edge of each spacing panel 19 located at the side of a closure engaging panel 16 with the hinged line of attachment 31, perpendicular to the hinged line of attachment 31, onto the body 11. Between adjacent closure engaging panels 16 two additional outer supporting panels 43 are shaped similarly to outer supporting panels 17 and are defined by a cut 44 of substantially the same shape, size, and relative location with respect to the hinged line of attachment 31 as cut 47, along with the adjacent score lines 35 and the hinged line of attachment 31. Each spacing panel 19 adjacent an additional outer supporting panel 43 also has a cut 41 extending substantially the entire width of the panel along the hinged line of attachment 31. Each spacing panel 19 also has a pair of score lines 67, 68 extending across the central portion thereof connecting the ends of adjacent cuts 47, 48, respectively, or, in the case of spacing panels 19 at the end of a closure engaging panel 16, from the end of cuts 47 and 48, respectively, to the end of the closure engaging panel 16.

The main body panel 11 of the blank 30 has, at one end thereof, a sealing panel 51 defined by a score line 52. A foldable sealing panel 54 defined by a hinged line of attachment 55 is located at the end of the body 11 opposite the sealing panel 51. The foldable sealing panel 54 is adapted to be folded inward of the remainder of body panel 11 along the hinged line of attachment 55 then overlapped with the sealing panel 51 and sealed to panel 51 when the blank 30 is assembled to form a tubular container body. Although the hinged line of attachment 55 is illustrated as an interrupted cut line, it can be a score line or any other similar line along which the hinged sealing panel 54 can be folded. Although a preferred embodiment utilizing a hinged sealing panel 54 has been illustrated, another preferred embodiment deletes the hinged sealing panel 54 so that the blank 30 is terminated along the same line as the hinged line of attachment 55. In the embodiment not having a hinged sealing panel 54, the sealing panel 51 is adhered to the opposite end of the body panel 11 to form a container body.

A score line 37 extends the entire distance across body panel 11, perpendicular to a point between closure engaging panels 14. Score line 37 and score line 52 are preferably arranged so that they are located exactly opposite each other on the assembly body 11, permitting the assembled body 11, without end closures, to be folded along score lines 37 and 52 and collapsed for shipment and handling.

Along the side of the blank 30 opposite the closure engaging panels 16 are reinforcing panels 56. The reinforcing panels 56 are connected to the body 11 along a hinged line of attachment 38. The hinged line of attachment 38 is preferably a score line but can be any other means of forming a line along which the reinforcing panels 56 can be folded outwardly from the body 11 when the blank 30 is formed into a container body. The reinforcing panels 56 are separated by a cut 58 extending outwardly from and perpendicular to the foldable line of attachment 38 at the point of intersection between the foldable line of attachment 38 and score line 37. The reinforcing panels 56 are designed primarily for use with a closure having a downwardly extending annular flap. When used with such a closure, the panels 56 are folded outwardly from the body 11 to provide a friction fit with the closure, and the closure rests along the fold line formed by folding the reinforcing panels 56 along the hinged line of attachment 38. In addition to providing a fitting which will engage the described closure, the reinforcing panels 56 add rigidity to the end of the container during the container handling and filling process prior to application of a closure. In other embodiments utilizing other closure mechanisms known in the art or a closure mechanism constructed in accordance with this invention, the reinforcing panels 56 could be deleted or replaced with appropriate means adapted for use with the particular closure desired.

FIG. 9 is a partial plan view of a blank from which a container having the closure engaging means 14' illustrated in FIGS. 3 and 6, can be constructed. In this embodiment the closure engaging means 14' comprises a plurality of closure engaging panels 16'. A substantial number of the features of blank 30 illustrated in FIG. 8 are substantially the same in design, size, location and function on blank 30' of FIG. 9. Among these features are the bonding strips 28, 28'; the hinged lines of attachment 31, 31' and 32, 32'; the inner supporting panels 18, 18'; cuts 48, 48'; cuts 42, 42'; score lines 33, 33', 34, 34', 35, 35', 37, 37', 67, 67', and 68, 68'; sealing panel 51, 51'; score line 52, 52'; foldable sealing panel 54, 54', or the absence thereof; and hinged line of attachment 55, 55'. The only substantial difference between the blank 30 of FIG. 8 and the blank 30' of FIG. 9 is the omission in blank 30' of the cuts 47 and cuts 41. The panels 43, 43' can be either omitted or retained as desired. Although the closure engaging means 14' as illustrated in FIGS. 3 and 6, could be constructed from the blank shown in FIG. 8, delection of cuts, score lines, and panels which perform no essential function in the embodiment employing a metal band 24 as part of the closure engaging means can be accomplished in order to simplify construction and reduce manufacturing costs. Depending upon the economies involved in each individual situation, the production of blanks for closure engaging means of both embodiments might be carried out using only the blank illustrated by FIG. 8.

FIG. 10 is a plan view of a blank from which a container having the closure engaging means 14'' illustrated in FIGS. 4 and 7 can be constructed. In this embodiment the closure engaging means 14'' comprises a plurality of closure engaging panels 16''. A substantial number of the features of the blank 30 illustrated in FIG. 8 are substantially the same in design, size, location, and function on blank 30' of FIG. 10. Among these are the bonding strips, 28, 28''; the hinged lines of attachment 31, 31'', and 32, 32''; the inner supporting panels 18, 18''; cuts 48, 48''; additional outer supporting panels 43, 43''; score lines 67, 67'', and 68, 68''; sealing panel 61, 61''; score line 52, 52''; foldable sealing panel 54, 54'' or the absence thereof; and hinged line of attachment 55, 55''. The score lines 33'', 34'', 35'', and 37'' are in the same relative locations with regard to their respective spacing panels 19'', closure supporting panel groups 22'', and additional outer supporting panels 43'' as are the corresponding score lines 33, 34, 35, and 37 of FIG. 8. The score lines 33'', 34'', 35'', and 37'' of FIG. 10, however, extend across the body 11'' of the blank from the top to the bottom thereof. Due to the fact that in the embodiment of FIG. 10 each closure engaging panel 16'' contains only one closure supporting panel group 22'', each spacing panel 19'' is at the end of a closure engaging panel 16'' and no cuts corresponding to cuts 42 or 42' of the embodiments of FIGS. 8 and 9 appear on the blank. If, however, each closure engaging panel 16'' contained more than one closure supporting panel group 22'' the interior spacing panels 19'' could be provided with a cut similar to cuts 42 of FIG. 8 along the score line 32''.

The ends of the cut 47'' adjacent score lines 33'' are located in substantially the same relative location as the ends of cut 17 of FIG. 8 and are located distance D from the corresponding ends of each associated cut 48''. The cuts 17'' are, however, substantially straight cuts which are substantially parallel to the score line 31''. In addition, cuts 71 along each score line 33'' between cuts 47'' and cuts 48'' provide for removal from the blank 30'' of a portion bounded by each cut 47'', 48'' and their associated cuts 71, an area generally analogous to the medium panel 45 of FIG. 8. A cut 61 extends along the score line 31'' adjacent each closure supporting panel group 22''. The cut 61 provides for folding of the closure supporting panel group 22'' flat against the inside of the body 11'' of the blank 30'' during assembly of a container therefrom. Each outer supporting panel 17'' is therefore defined by a portion of a cut 47'', a portion of a score line 34'', a portion of a cut 72, and a portion of a score line 33''.

In order to provide for efficient formation of the blank 30'' into a container having the construction illustrated by FIGS. 4 and 7, an adhesive material 75 can be applied to each of the closure engaging panels 16''. In the embodiment illustrated, such an application of adhesive material 75 is preferred to cover at least a portion of each additional outer supporting panel 43'', each outer supporting panel 17'', each spacing panel 19'', and the portion of the bonding strip 28'' adjacent each spacing panel 19''. FIG. 10 illustrates an adhesive 75 applied to such areas on one of the four illustrated closure engaging panels 16''.

Although the side of the blank 30'' opposite the closure engaging means 14'' can be of any suitable configuration including that of the closure engaging means 14 of FIG. 8 or closure engaging means 14' of FIG. 9, an additional useful and advantageous closure engaging means 114 is illustated. The closure engaging means 114 is attached to the body 11'' of the blank 30'' along a score line 131 or other suitable hinged line of attachment and comprises a plurality of closure supporting panel groups 122 separated by spacing panels 119. Each closure supporting panel group 122 comprises a pair of outer closure supporting panels 117 which are identical in size and shape to the outer closure supporting panels 17 of FIG. 8. An additional outer supporting panel 143 can be located adjacent the spacing panel 119 at each end of the closure engaging means 114 as illustrated. Each spacing panel 119 is separated from the adjacent outer supporting panels 117 by the extension of a score line 33'' or 35'' as illustrated. Each spacing panel can also be at least partially coated with an adhesive material 75 for use in sealing the spacing panel 119 to the inside of the body 11''.

Located on the body 11'' of the blank 30'' adjacent each spacing panel 119 and located across the score line 131 from the spacing panel 119 a distance equal to the thickness of the spacing panel 119 plus a distance D is a cut 120. The cut 120 can be either straight or curved but is preferably an arcuate cut with its central portion being nearer the score line 131 than the ends thereof. Each cut 120 extends from a score line 35'' to the adjacent score line 33''. In addition, a small cut 121 extending from the central portion of the cut 120 a very short distance toward the score line 131 can be made to facilitate use of the cut 120 to assist in maintaining a closure at the bottom of the finished container.

To form a blank 30 or 30' into a tubular body for a container, the panels 28, 28' are folded inwardly from closure engaging panels 16 or 16' along the hinged lines of attachment 32, 32' at an angle of approximately 180°. The closure engaging panels 16 or 16' are then folded inwardly from the main body panel 11 or 11' along the hinged lines of attachment 31, 31' at an angle of approximately 180° to bring the bonding strips 28, 28' in contact with the inside surfaces of the body panels 11 and 11'. The closure engaging panels 16 or 16' can be maintained in this position by bonding the bonding strips 28, 28' to the inside surface of the body panels 11 and 11' using a hot melt adhesive or any other similar means known in the art. If the closure configuration of the second end of the container is to have a configuration in accordance with the invention, similar folding and adhering steps can be conducted simultaneously or subsequently at that end of the container. If another type of closure is to be used at the second end of the container, suitable preforming or shaping of the second end of the container can be accomplished as necessary. If reinforcing panels 56 as shown in FIG. 8 are provided for engagement of an enclosure 13 as illustrated by FIG. 1, each panel 56 is folded outwardly from the body 11 along the line 38 at an angle of approximately 180° and is adhered to the body 11 using hot melt adhesive or any similar means of attachment known in the art.

If a hinged sealing panel 54 or 54' is to be utilized, the hinged sealing panel 54, 54' is folded inwardly from the body panel 11 or 11' along the hinged line of attachment 55, 55' at an angle of approximately 180° and is adhered to body panel 11 or 11' using hot melt adhesive or any other means of attachment known in the art. The blank 30 or 30' is then curved to bring the sealing panel 51, 51' in contact with the hinged sealing panel 54, 54' in an overlapping relationship and is adhered to panel 54, 54' using hot melt adhesive or other means of attachment known to the art. The container body thus assembled can be folded along score lines 37 or 37' and 52 or 52' to a flattened position with folds of approximately 180° at both score lines 37, 37' and 52, 52'. In this flattened position the tubular body and associated closure engaging means can be stored, shipped, or otherwise handled with a minimum of space requirements while awaiting further assembly and attachment of the closure means.

To form a blank 30'' into a tubular body for a container, each closure engaging panel 16'' is folded inwardly along the hinged line of attachment 32'' at an angle of approximately 180°. The closure engaging panels 16'' are then adhered to the inside of the main body panel 11'' so that each additional outer supporting panel 43'', each spacing panel 19'', each outer supporting panel 17'', and the portion of each bonding strip 28'' adjacent each spacing panel 19'' is bonded to the inside of the container body panel 11''. The closure engaging means 114 is then folded inwardly along its hinged line of attachment 131 at an angle of approximately 180° and each spacing panel 119 is adhered to the inside of the body panel 11''. If a hinged sealing panel 54'' is to be utilized, the hinged sealing panel 54'' is folded inwardly from the body panel 11'' along the hinged line of attachment 55'' at an angle of approximately 180° and is adhered to the body panel 11'' using any suitable adhesive means. The blank 30'' is then curved to bring the sealing panel 51'' in contact with the hinged sealing panel 54'' in an overlapping relationship and is adhered to the panel 54'' using any suitable adhesive means. The container body thus assembled can be folded along the score line 52'' and the score line 37'' opposite score line 52'' to form a flattened, partially assembled container which can be stored, shipped or otherwise handled with a minimum of space requirement while waiting further assembly.

When a container utilizing the container body illustrated by FIG. 8, 9, or 10 is to be assembled, the flattened container body can be opened and further assembled using a minimum of equipment. Forming the container body 11, 11' or 11'' into a curved, usually a generally circular, shape will cause the supporting panels 17, 18, 43, 18', 43', 17'', 18'', 43'', 117, and 143 to be displaced inwardly toward the central part of the container to aid in supporting a container closure 12 as illustrated by FIG. 1. In the embodiment of FIG. 10, the material adjacent each cut 120 opposite the small cut 121 will tend to protrude inwardly into the container space and will assist in maintaining a flat disk-shaped closure 12 within the distance D between the cut 120 and the inwardly folded closure engaging means 114.

Reasonable variations and modifications of my invention are possible within the scope of this disclosure without departing from the scope and spirit thereof.

What is claimed is:

1. A container comprising:

a tubular body having a first end and a second end;

a first closure engaging means associated with said first end of said tubular body, said first closure engaging means comprising a plurality of closure engaging panels connected by a first hinged line of attachment to, and folded inwardly from, said first end of said body; each said closure engaging panel comprising:

1. a bonding strip located along the side of said engaging panel opposite said first hinged line of attachment to said first end of said body, said bonding strip adhered to the inside surface of said body;
2. at least one closure supporting panel group, each said supporting panel group comprising two inner supporting panels attached to said bonding strip along a second hinged line of attachment; and
3. a plurality of spacing panels positioned so that each end of each said supporting panel group is adjacent a spacing panel;

first closure means adapted to be operably engaged to said first closure engaging means;

a second closure engaging means associated with said second end of said tubular body; and second closure means adapted to be operably engaged to said second closure engaging means.

2. A container in accordance with claim 1 wherein each said inner supporting panel is connected along a score line to an adjacent spacing panel.

3. A container in accordance with claim 2 wherein said second hinged line of attachment and one of said score lines intersect at one corner of each said inner supporting panels and wherein each said inner supporting panel is attached to other portions of said first closure engaging means only along said second hinged line of attachment and along said score line.

4. A container in accordance with claim 3 wherein the angle of intersection between said second hinged line of attachment and said score line is within the range of from about 90° to about 120°.

5. A container in accordance with claim 4 wherein said first closure means comprises a flat circular closure sized to fit within said first end of said body and to contact an unattached portion of each said inner supporting panel.

6. A container in accordance with claim 1 wherein each said supporting panel group additionally comprises two outer supporting panels attached to said container body along said first hinged line of attachment and spaced from said inner supporting panels by a preselected distance D.

7. A container in accordance with claim 6 wherein each said inner supporting panel is connected along a first score line portion to an adjacent spacing panel and wherein each said outer supporting panel is connected along a second score line portion to an adjacent spacing panel.

8. A container in accordance with claim 7 wherein said first hinged line of attachment and one of said second score line portions intersect at one corner of each said outer supporting panels; wherein each said outer supporting panel is attached to other portions of said container only along said first hinged line of attachment and along one of said second score line portions; wherein said second hinged line of attachment and one of said first score line portions intersect at one corner of each said inner supporting panels; and wherein each said inner supporting panel is attached to other portions of said container only along said second hinged line of attachment and along one of said first score line portions.

9. A container in accordance with claim 8 wherein the angle of intersection between said first hinged line of attachment and said each second score line portion is within the range of from about 90° to about 120° and wherein the angle of intersection between said second hinged line of attachment and each said first score line portion is within the range of from about 90° to about 120°.

10. A container in accordance with claim 9 wherein said first closure means comprises a flat circular closure having an edge thickness equal to or less than D and being sized to fit within said first end of said body between an unattached portion of each said inner supporting panel and an unattached portion of each said outer supporting panel.

11. A container in accordance with claim 1 additionally comprising a metal band folded around said first hinged line of attachment and affixed to said first end of said body, said metal band extending across each said closure engaging panel to within a distance D of each said inner supporting panel.

12. A container in accordance with claim 11 wherein each said inner supporting panels is connected along a score line to an adjacent spacing panel.

13. A container in accordance with claim 12 wherein said second hinged line of attachment and one of said score lines intersect at one corner of each said inner supporting panels and wherein each said inner supporting panel is attached to other portions of said first closure engaging means only along said second hinged line of attachment and along said score line.

14. A container in accordance with claim 13 wherein the angle of intersection between said second hinged line of attachment and each said score line is within the range of from about 90° to about 120°.

15. A container in accordance with claim 14 wherein said first closure means comprises a flat circular closure sized to fit within said first end of said body and to contact an unattached portion of each said inner supporting panel.

16. A container in accordance with claim 1 wherein each said supporting panel group additionally comprises two outer supporting panels, each of said outer supporting panels being connected to the other and to its adjacent spacing panel and being unconnected to any other portion of said container, the outer supporting panels and inner supporting panels of each supporting panel group being separated by a distance D.

17. A container in accordance with claim 16 wherein each said inner supporting panels is connected along a score line to an adjacent spacing panel.

18. A container in accordance with claim 17 wherein said second hinged line of attachment and one of said score lines intersect at one corner of each said inner supporting panels and wherein each said inner supporting panel is attached to other portions of said first closure engaging means only along said second hinged line of attachment and along said score line.

19. A container in accordance with claim 18 wherein the angle of intersection between said second hinged line of attachment and said score line is within the range of from about 90° to about 120°.

20. A container in accordance with claim 19 wherein each said outer supporting panel and each said spacing panel is adhered to the inside surface of said body.

21. A container in accordance with claim 20 wherein said first closure means comprises a flat circular closure having an edge thickness less than D and being sized to fit within said first end of said body and to contact an unattached portion of each said inner supporting panel.

22. A container in accordance with claim 20 wherein said second enclosure engaging means comprises:

1. a plurality of additional supporting panel groups, each comprising two additional supporting panels attached to and folded inwardly from said second end of said body along a third hinged line of attachment, each said additional supporting panel group being adjacent and attached to an additional spacing panel which is attached to and folded inwardly from said second end of said body along said third hinged line of attachment and adhered to the inside surface of said body; and
2. a plurality of cuts in said tubular body spaced inwardly from said additional spacing panels by a distance D.

23. A container in accordance with claim 22 wherein said second closure means comprises a flat circular closure having an edge thickness less than D and being sized to fit within said second end of said body and to contact an unattached edge portion of each said modified supporting panel.

24. A blank from which a tubular container body can be formed, said blank comprising:

a generally rectangular main body having first and second sides and first and second ends; and a plurality of closure engaging panels attached to said first side of said main body along a first hinged line of attachment, each said closure engaging panel comprising:

1. a bonding strip located along the side of said engaging panel opposite said first hinged line of attachment and attached to the remainder of said engaging panel along a second hinged line of attachment, said second hinged line of attachment being generally parallel to said first hinged line of attachment;
2. at least one closure supporting panel group, each said supporting panel group comprising two inner supporting panels attached to said bonding strip along said second hinged line of attachment; and
3. a plurality of spacing panels, each end of each said closure supporting panel group being adjacent a spacing panel and attached thereto along a first score line portion which intersects said second hinged line of attachment.

25. A blank in accordance with claim 24 wherein each said inner supporting panel is attached to the remainder of said closure engaging panel only along said second hinged line of attachment and along said first score line portion and wherein the portion of said second hinged line of attachment adjacent said inner supporting panel and said first score line portion intersect at an angle within the range of from about 90° to about 120°.

26. A blank in accordance with claim 25 wherein a body score line extends from each edge of each said spacing panel adjacent said first hinged line of attachment and from the center of each supporting panel group adjacent said first hinged line of attachment, partially across said rectangular main body.

27. A blank in accordance with claim 24 wherein each said supporting panel group additionally comprises two outer supporting panels each attached to said container body along said first hinged line of attachment and to an adjacent spacing panel along a second score line portion which intersects said first hinged line of attachment, said outer supporting panels being spaced from said inner supporting panels by a preselected distance D.

28. A blank in accordance with claim 27 wherein each said inner supporting panel is attached to the remainder of said closure engaging panel only along said second hinged line of attachment and along said first score line portion, wherein the portion of said second hinged line of attachment adjacent said inner supporting panel and said first score line portion intersect at an angle within the range of from about 90° to about 120°, wherein each said outer supporting panel is attached to the remainder of said closure engaging panel only along said first hinged line of attachment and along said second score line portion, and wherein the portion of said first hinged line of attachment adjacent said inner supporting panel and said second score line portion intersect at an angle within the range of from about 90° to about 120°.

29. A blank in accordance with claim 28 wherein a body score line extends from each edge of each said spacing panel adjacent said first hinged line of attachment and from the center of each supporting panel group adjacent said first hinged line of attachment, partially across said rectangular main body.

30. A blank in accordance with claim 28 wherein each said supporting panel group additionally comprises two outer supporting panels, each of said outer supporting panels being connected to the other and to its adjacent spacing panel and being unconnected to any other portion of said container, said outer supporting panels being spaced from said inner supporting panels by a distance D.

31. A blank in accordance with claim 30 wherein each said inner supporting panel is attached to the remainder of said closure engaging panel only along said second hinged line of attachment and along said first score line portion and wherein the portion of said second hinged line of attachment adjacent said inner supporting panel and said first score line portion intersect at an angle within the range of from about 90° to about 120°.

32. A blank in accordance with claim 31 wherein a body score line extends from each edge of each said spacing panel adjacent said first hinged line of attachment and from the center of each supporting panel group adjacent said first hinged line of attachment, completely across said rectangular main body.

33. A blank in accordance with claim 32 additionally comprising a closure engaging means attached to said second side of said main body along a third hinged line of attachment, said closure engaging means comprising:

1. a plurality of additional closure supporting panel groups,
2. each said additional supporting panel group comprising two additional supporting panels attached to said main body along said third hinged line of attachment;
3. a plurality of additional spacing panels, each end of each said additional closure supporting panel group being adjacent an additional spacing panel and attached thereto along a third score line portion which intersects said third line of attachment; and a plurality of cuts extending between adjacent said body score lines, said cuts being located a preselected distance from said third hinged line of attachment.

34. A blank in accordance with claim 32 wherein each said spacing panel, each said outer supporting panel and the portions of said bonding strip adjacent each said spacing panel are coated with an adhesive material.

* * * * *